United States Patent [19]

Remlinger et al.

[11] 4,250,954

[45] Feb. 17, 1981

[54] HEAT CONTROL MEMBER AND METHOD

[76] Inventors: George W. Remlinger, 8 Wendy Rd., Greenfields; Arthur K. Kreider, 12 Jeffrey Rd., Greenfields, both of Reading, Pa. 19601

[21] Appl. No.: 75,105

[22] Filed: Sep. 13, 1979

[51] Int. Cl.[3] ..... F28F 13/06

[52] U.S. Cl. ..... 165/1; 165/99; 165/129; 165/136; 219/366; 237/79

[58] Field of Search ..... 165/137, 55, 129, 98, 165/99, 135, 136, 96, 134, 1; 237/79; 219/366 X

[56] References Cited

U.S. PATENT DOCUMENTS

| | | | |
|---|---|---|---|
| 1,630,529 | 5/1927 | Drlica | 237/79 |
| 1,709,559 | 4/1929 | Blackman | 165/129 |
| 1,744,511 | 1/1930 | Shurtleff | 237/79 |
| 1,816,604 | 7/1931 | Murray, Jr. | 165/96 |
| 1,859,612 | 5/1932 | Altheimer | 237/79 X |
| 1,908,331 | 5/1933 | Ehramjian | 237/79 |
| 1,935,900 | 11/1933 | Altheimer | 237/79 X |
| 2,068,550 | 1/1937 | Knight | 165/96 |
| 2,359,454 | 10/1944 | Whelan | 165/55 |
| 3,274,919 | 9/1966 | Wegman | 165/96 |
| 3,804,157 | 4/1974 | Wenig | 165/96 |
| 3,924,619 | 12/1975 | Banjavich et al. | 165/96 |

FOREIGN PATENT DOCUMENTS

| | | | |
|---|---|---|---|
| 420372 | 8/1924 | Fed. Rep. of Germany | 165/98 |
| 2027496 | 12/1971 | Fed. Rep. of Germany | 237/79 |
| 2250935 | 4/1974 | Fed. Rep. of Germany | 237/79 |
| 2644929 | 4/1978 | Fed. Rep. of Germany | 165/137 |
| 1457596 | 11/1966 | France | 219/202 |

*Primary Examiner*—Sheldon J. Richter
*Attorney, Agent, or Firm*—Ernest G. Szoke

[57] ABSTRACT

A cover and method for controlling heat transfer from a room heating unit are disclosed. The cover includes a shell having a cross section adapted to be placed over and enclose a heating unit to limit or preclude heat flow. The cover can also include thermal insulation for limiting radiative and conductive heat flow. In a preferred arrangement, the shell is formed of a readily shearable sheet metal to facilitate installation by a homeowner.

5 Claims, 4 Drawing Figures

FIG. 1
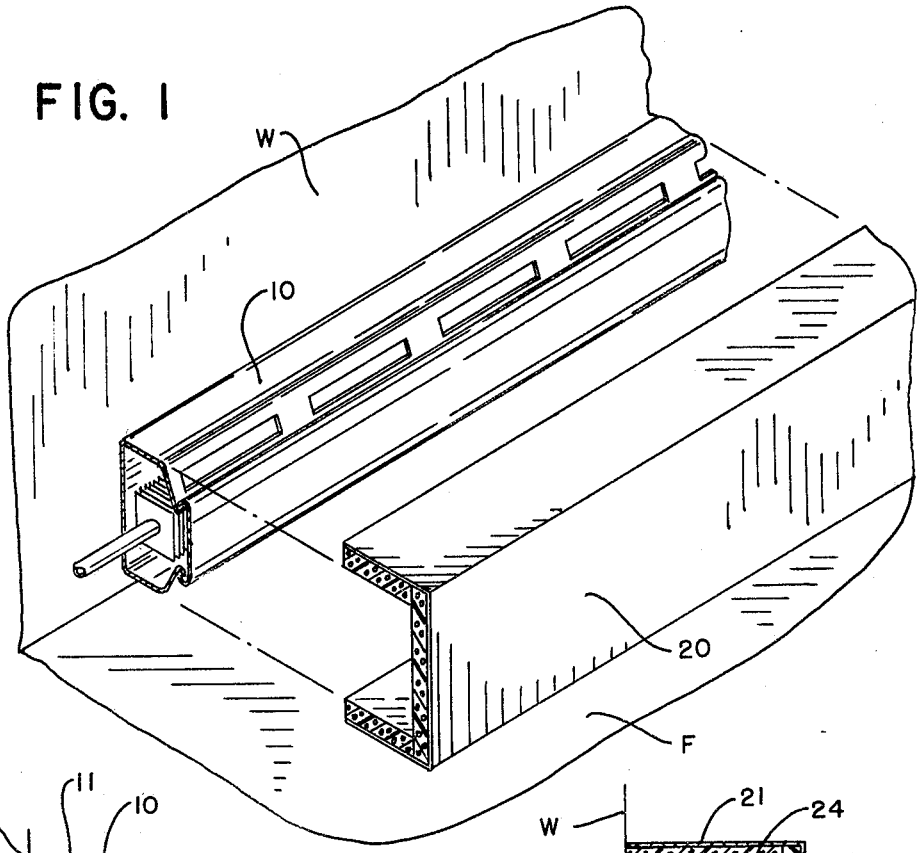
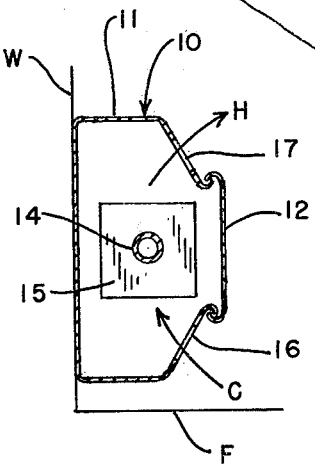
FIG. 2
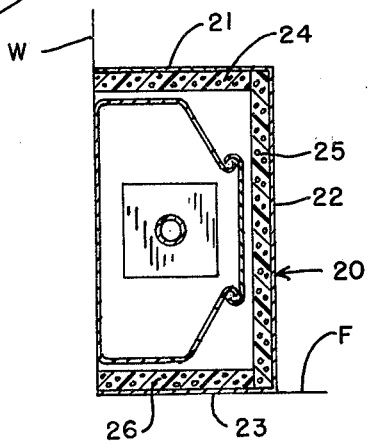
FIG. 3
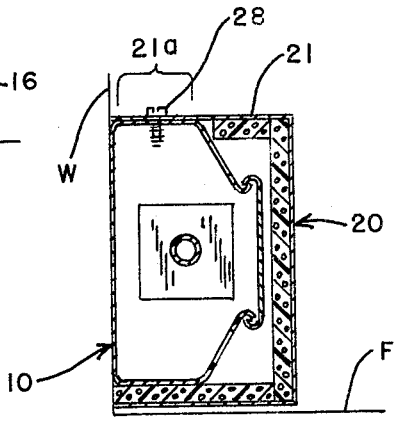
FIG. 4

HEAT CONTROL MEMBER AND METHOD

FIELD OF THE INVENTION

This invention relates to energy-saving means for room heating systems and especially to systems employing baseboard-type convective heaters.

BACKGROUND OF THE INVENTION

This invention has been developed primarily in the context of the control of heat losses in residential heating systems utilizing the so-called "baseboard"-type heating units and the invention will be described in that context, although it should be realized that the invention has broad applicability to other forms of heating systems.

Many dwellings are heated by oil-fired hot water systems in which the heated water is circulated throughout the house to a plurality of heating units, there usually being at least one such heating unit in each room. The conventional room heating unit in use are the so-called "baseboard" heating units that comprise a relatively long, low unit mounted on the wall of the room at the juncture of the wall with the floor and thus in the position normally occupied by the baseboard trim. Although many such systems are "zoned," meaning that there are at least two parallel heating circuits in the system, each of which is under separate thermostatic control, the majority of systems in residential use are unzoned, meaning that the heated water from the furnace passes through each heating unit in the house. Thus, every room in the home, whether it is occupied or not, is heated. Obviously, the more heat that is lost from the heated water as it travels through the system, the more fuel must be consumed in order to provide the desired quantity of heated water to the entire system to heat adequately those rooms that are occupied. In addition, such systems usually employ a single thermostatic control, usually placed at a central location in the home, and this results in either the entire home being heated to the same temperature or heat imbalances in the system resulting from the fact that other rooms in the house may be colder because of exposure to the wind, location and distance from the heater, etc.

Moreover, even in the more sophisticated zoned systems, there are usually only two or three loops in the system, each of which heats several rooms of the house. Thus, even though each zone may be controlled by its own thermostat, it is usually not possible to limit the amount of heat provided to any one room served by the loop.

In some baseboard heater unit designs, the housing is provided with a damper for controlling the amount of air flow from the heat exchanger, so that the amount of heat transferred to the room can be regulated. However, such dampers generally do not cut off the air flow completely and tend to become inoperative with age. Moreover, this added feature increases the cost of the unit and thus is not found in a large proportion of heating systems in use at the present time.

SUMMARY OF THE INVENTION

It is an object of the invention to provide an effective, inexpensive means and method for eliminating or limiting heat transfer from previously installed heating units.

It is further an object to provide an energy-saving heat transfer control means that can be readily installed by a home owner without the need for expensive installation procedures or tools.

Basically, these objectives are achieved by means of a shell member adapted to fit over and closely surround an installed heating unit to block heat transfer from the unit. Thermal insulation may be applied to inner surfaces of the shell for improving the heat-blocking capabilities of the shell. Preferably, the shell is constructed in a manner and made of a material such that the shell is readily shearable, such as by a hand saw or hand shears or scissors. Also, preferably, the exterior surface of the shell carries a decorative coating.

DESCRIPTION OF THE DRAWINGS

FIG. 1 is a perspective view showing a typical placement of a cover in accordance with Applicants' invention.

FIG. 2 is a cross section through a typical baseboard-type heating unit.

FIG. 3 is a cross sectional view of the heating unit of FIG. 2 with one form of a heat-blocking cover in accordance with Applicants' invention installed over the heating unit.

FIG. 4 is a cross sectional view of another form of heat-blocking cover that includes means for securing the cover to the heating unit.

DESCRIPTION OF THE PREFERRED EMBODIMENT

FIG. 1 illustrates a typical manner in which Applicants' heat-blocking cover is used. A conventional baseboard heating unit 10 is shown installed on the wall W adjacent the floor F. A cover 20 in accordance with Applicants' design is placed over all or a portion of the heating unit 10 in order to block or limit the amount of heat transfer either by convection, radiation or conduction, from the unit 10 into the room. The cover 20 will be further described below.

Referring to FIG. 2, conventional baseboard heating units include an outer housing 11 and a front cover 12. Within the housing 11 is supported a conventional finned tube heat exchanger comprising a tube 14 through which an appropriate heat transfer medium, such as hot water, passes. Heat transfer from the tube 14 is enhanced by a plurality of closely spaced metallic fins 15. Such units usually have a cool air inlet port or slot 16 through which the cooler air adjacent the floor F enters the heating unit, as represented by arrow C, and a heated air outlet port or slot 17, through which the heater air flows, as represented by arrow H, after passing over the heat exchanger. These units provide for heat transfer primarily by convection and have been in use for quite a few years so that no further details concerning the construction of such units is believed necessary.

In most residential heating systems, it is common to employ at least one baseboard heating unit along a wall of the room, although it is equally common to deploy such units on more than one wall, especially if the room is relatively large.

FIG. 3 shows a thermal insulating cover in accordance with Applicants' invention installed over a heating unit of the type shown in FIG. 2. Typically, the cover 20 comprises an elongate exterior shell that is shaped to enclose the heating unit 10 on all exposed sides. Thus, for heating units that are installed somewhat above the floor surface, the shell can comprise an upper panel 21, face panel 22 and a bottom panel 23.

Although the particular shape of the shell is a matter of choice, the "U"-shaped configuration shown has advantages from the standpoints of manufacturing ease and ease of use by the installer. Typically, the transverse dimension of the panel 22 may be on the order of 1.5 to three times that of either or both of the panels 21 or 23.

A significant aspect of the shape of the shell is that it encloses the heating unit 10 so as to prevent the flow of air to and from the heating unit 10, thereby limiting convective heat transfer. In addition, it is desirable to shape the shell so that a substantial portion is spaced from the surfaces of the heating unit in order to provide a space or gap to lessen the amount of heat transfer by radiation or conduction from the heating unit to the shell.

In order to insure further against such radiant or conductive heat transfer, it is desirable to place an insulating means or barrier on at least some of the interior surfaces of the shell. Thus, referring to FIG. 3, layers 24, 25 and 26 of an appropriate thermal insulation material are applied to the portions 21, 22 and 23 respectively of the shell. Virtually any type of the commonly available thermal insulating materials may be used, a preferred material being glass fiber insulation. If a relatively thin material is used to form the shell, then it is desirable to employ a thermal insulating material that imparts some rigidity to the shell. One material that has been found particularly useful is polystyrene foam that is usually sold under the name "styrofoam." Any appropriate means, for example, an adhesive, can be utilized for securing the insulating material to the shell.

It should be realized that if the heating unit 10 is mounted so that there is little or no space between the unit and the floor F, it would be desirable to use a cover that has a relatively short portion 23 or that, perhaps, has no lower portion 23, thereby resulting in the bottom edge of the panel 22 directly engaging the floor F and preventing the flow of air to the heating unit.

Alternatively, it may be desirable to form the cover with the bottom panel 23 bent toward the top panel 21, perhaps making an angle of about 80° with the face panel 22. This arrangement provides a "snap-on" mounting of the cover on the heating unit, assuming the vertical dimension of the heating unit is somewhat greater than the distance between the free edges of the panels.

The shell 20 can be made of a wide variety of materials, so long as the material is sufficiently form stable and resistant to temperatures on the order of 180°-200° F. usually encountered in such installations. It is also desirable that the material be one that can be cut very readily by widely available hand tools such as shears, scissors or hand saws. One material that has been found particularly useful is 0.019" mild aluminum sheet that is prefinished with a decorative coating, for example, paint, on one or both sides. This material can be readily formed and the exterior of the shell needs no further finishing after installation.

By the use of a shell material that is easily cut or sheared, the ease of installation is greatly enhanced and can be accomplished by most homeowners. In order to use the cover, the installer merely cuts a length of the cover to match the desired length of the heating unit 10 that is being covered. The cut length of cover can then be slipped into place and can be held in position, for example, by frictional contact between the cover and the heating unit, or can merely rest on the floor. Alternatively, the cover can be secured directly to the heating unit and one means of accomplishing this is shown in FIG. 4. In this arrangement, a portion 21*a* of the panel 20 is free of insulating material and overlies the top portion of the heating unit. A suitable securing means, such as a self-tapping sheet metal screw 28, is then utilized to secure the cover in place. The cover can then be provided with preformed holes for receiving the fastener 28 or, alternatively, the installer can provide such openings by drilling holes in the cover and underlying portion of the heating unit 10.

Of course, if it is desired merely to reduce but not totally block heat transfer to the room from the heating unit, then the cover 20 is cut to a length shorter than that of the heating unit. It should be further noted that in the event it is desired to restore heat to the room, the cover can be readily removed, thereby allowing heat transfer to the entire room.

Thus, it can be seen with Applicants' invention that it is quite easy to conserve the amount of fuel that would be necessary to heat unused rooms or to control the temperature of rooms by use of such covers. The only portion of the room that is heated is the relatively small volume enclosed by the cover. It is also contemplated that in installations wherein the ends of the heating unit do not abut with an adjoining wall, end parts can be supplied or can be readily fashsioned from, for example, sheet stock, for sealing the ends of the cover.

We calim:

1. A method for conserving heat energy by controlling heat flow from a previously installed system of hot water baseboard heating units that includes a multiplicity of heating elements enclosed in housings provided with ports for permitting air flow in proximity to the heating elements, comprising removably installing a cover over at least part of said heating units thereby to decrease the amount of heat lost from the hot water flowing through said units, said cover comprising a substantially fluid-impervious shell member having a cross section shaped to be disposed over the heating unit, said shell member including a face portion adapted to extend over the front surface of the heating unit, a top wall contiguous with one edge of the face portion and extending angularly with respect to the face portion and a bottom wall, contiguous with another edge of the face portion and extending angularly with respect thereto.

2. A cover for a baseboard heating unit having openings therein for convective heat transfer, comprising a substantially fluid-impervious shell member having a cross section shaped to be disposed over the heating unit to block convective heat transfer from the heating unit, said shell member including a face portion adapted to extend over the front surface of the heating unit, a top wall contiguous with one edge of the face portion and extending angularly with respect to the face portion and a bottom wall, contiguous with another edge of the face portion and extending angularly with respect thereto.

3. A cover as in claim 1 wherein the shell includes thermal insulating means disposed on an interior surface of the shell member.

4. A cover as in claim 1 wherein the shell member has substantially the form, in cross section, of a U-shaped channel.

5. Apparatus as in claim 1 wherein the shell is of a readily shearable material.

* * * * *